United States Patent [19]

Seiter et al.

[11] Patent Number: 4,675,124

[45] Date of Patent: Jun. 23, 1987

[54] GRANULAR DETERGENT OF IMPROVED DETERGENCY CONTAINING 2 ETHOXYLATED ALCOHOLS, AN ETHOXYLATED AMINE AND AN ANIONIC

[75] Inventors: Wolfgang Seiter, Neuss; Hans Andree, Leichlingen; Markus Berg, Duesseldorf, all of Fed. Rep. of Germany

[73] Assignee: Henkel Kommanditgesellschaft auf Aktien, Duesseldorf, Fed. Rep. of Germany

[21] Appl. No.: 853,491

[22] Filed: Apr. 18, 1986

[30] Foreign Application Priority Data

Apr. 20, 1985 [DE] Fed. Rep. of Germany ..... 3514364

[51] Int. Cl.[4] ..... C11D 1/44; C11D 3/075; C11D 11/02; C11D 17/06

[52] U.S. Cl. ..... 252/91; 252/140; 252/155; 252/174; 252/174.22; 252/174.24; 252/174.25; 252/529; 252/531; 252/540; 252/548; 252/550; 252/559; 427/220

[58] Field of Search ..... 252/91, 140, 155, 174, 252/174.22, 174.24, 174.25, 529, 531, 540, 548, 550, 559; 427/220

[56] References Cited

U.S. PATENT DOCUMENTS

| | | | |
|---|---|---|---|
| 3,222,201 | 12/1965 | Boyle | 106/285 |
| 3,223,644 | 12/1965 | Law | 252/106 |
| 3,691,081 | 9/1972 | Thompson | 252/174.22 |
| 3,741,912 | 6/1973 | Kaneko | 252/529 |
| 3,823,094 | 7/1974 | Lancz | 252/527 |
| 3,838,072 | 9/1974 | Smith | 252/540 |
| 3,849,347 | 11/1974 | Tokiwa | 252/545 |
| 3,868,336 | 2/1975 | Mazzola | 252/527 |
| 3,920,586 | 11/1975 | Bonaparte | 252/531 |
| 3,925,224 | 12/1975 | Winston | 252/89 |
| 4,064,063 | 12/1977 | Alder | 252/135 |
| 4,129,514 | 12/1978 | Caffarel | 252/174.22 |
| 4,136,051 | 1/1979 | Saran | 252/91 |
| 4,264,464 | 4/1981 | Gangwisch | 252/91 |
| 4,274,974 | 6/1981 | Kerkhoven | 252/90 |
| 4,276,326 | 6/1981 | Joshi | 427/220 |
| 4,288,339 | 9/1981 | Wilsberg | 252/90 |

FOREIGN PATENT DOCUMENTS

| | | |
|---|---|---|
| 25551B1 | 3/1981 | European Pat. Off. . |
| 2412837 | 10/1974 | Fed. Rep. of Germany . |

*Primary Examiner*—Dennis L. Albrecht

*Attorney, Agent, or Firm*—Ernest G. Szoke; Henry E. Millson, Jr.

[57] ABSTRACT

A detergent having improved detergency particularly with respect to greasy soil comprising (a) a mixture of water-insoluble nonionic surfactants, (b) a water-soluble anionic surfactant of the sulfonate or sulfate type, (c) a detergent builder and (d) other standard detergent ingredients. The nonionic surfactant comprises a mixture of (i) an ethoxylated $C_{16}$–$C_{18}$ alcohol with 4 to 6 glycolether groups, (ii) an ethoxylated $C_{10}$–$C_{14}$ alcohol with 4 to 6 glycolether groups and (iii) an ethoxylated $C_{10}$–$C_{18}$ alkylamine with 1 to 3 glycolether groups. The nonionic surfactant is adsorbed on a granular carrier material which is soluble or dispersible in water. The weight ratio of constituent (i) to constituent (ii) to constituent (iii) is within the range of 1:2(2-6):(0.8-2.5) and the weight ratio of the nonionic surfactant to the anionic surfactant is within the range of 4:1 to 4:3. The carrier material preferably comprises a spray-dried mixture of from 60 to 80% zeolite, from 3 to 20% of a copolymeric carboxylic acid, from 0.1 to 3% sodium silicate and water and may contain up to 40% by weight of nonionic surfactant. The carrier material which is impregnated with the nonionic surfactant is combined with other, optionally spray-dried powder constituents containing the other components to form a homogeneous powder mixture.

10 Claims, No Drawings

GRANULAR DETERGENT OF IMPROVED DETERGENCY CONTAINING 2 ETHOXYLATED ALCOHOLS, AN ETHOXYLATED AMINE AND AN ANIONIC

BACKGROUND OF THE INVENTION

1. Field of the Invention

This invention relates to a granular detergent having a specially selected combination of water-soluble anionic surfactants and water-insoluble nonionic surfactants. The detergent exhibits improved cleaning ability with respect to oily and greasy soil.

2. Description of Related Art

U.S. Pat. No. 3,849,347 describes a gel-like detergent for pretreating grease-soiled fabrics. The detergent contains a mixture of a lipophilic nonionic surfactant and an anionic alkylbenzene sulfonate surfactant. Examples of the nonionic surfactant component include the adduct of a 70:30 (by weight) mixture of lauryl alcohol and myristyl alcohol and 3 moles of ethylene oxide per mole of alcohol and the adduct of nonylphenol and 5 moles of ethylene oxide. The preferred anionic surfactant is a linear alkylbenzenesulfonate in which the alkyl group has 10–15 carbon atoms.

Use of this detergent, however, is difficult and time consuming because it involves pretreatment of fabrics with the gel for about 30 minutes before loading into the washing machine. Unfortunately, these detergents generally are difficult to incorporate in a standard, granular multipurpose detergent because of their gel-like character.

U.S. Pat. No. 3,925,224 discloses that the addition of a water-insoluble surfactant composition to detergents containing standard water-soluble, anionic, nonionic or zwitter-ionic surfactants produces an increase in detergency. Primary alcohol-ethylene oxide adducts containing from 12 to 15 carbon atoms in the alcohol chain and an average 3 ethylene oxide groups (EO), octylphenol-ethylene oxide adducts containing 3 (EO) groups and cocosamine-ethylene oxide adducts containing 2 (EO) groups are specifically mentioned as examples of the water-insoluble surfactant.

The water-insoluble surfactant additive is added separately to the detergent or wash liquor in the form of a liquid or solid. Solid additives may contain from 0.1 to 60% by weight of the water-soluble surfactant composition, which also embraces mixtures of water-insoluble and water-soluble surfactants, and from 99.9 to 40% by weight of builder salts, fillers, bleaches and other detergent ingredients. Preferably, the additive contains 0.5 to 20%, more particularly, 1 to 10% and most particularly from 1 to 5% by weight of the water-insoluble surfactant. The water-insoluble surfactants may be dry-mixed into the detergent additive composition rather than by spray-drying so that surfactant losses through "pluming" in the spray drying tower is not a problem.

Nonionic surfactants having a low degree of ethoxylation are oily. These surfactants are difficult to incorporate in standard granular detergents in relatively large quantities, i.e., in quantities exceeding 5% to 8%, because they impair the detergent's free-flowing properties. U.S. Pat. No. 3,925,224 does not suggest how relatively large quantities of these surfactants, i.e., quantities of up to 60% by weight, can be incorporated in powdered detergents without adversely affecting their fluidity. Generally, spray-drying is out of the question because of the pronounced tendency of these components towards "pluming" in the off-gases of the spray-drying tower.

Accordingly, it is an important object of the present invention to provide a granular detergent which is distinguished by its high detergency, particularly with respect to oily and greasy soil. A further object of the invention is a granular detergent formulation having detergency-boosting additives which do not adversely effect the free-flowing properties of the detergent and which do not contribute to undesirable pluming in the spray-drying tower during production of the detergent.

DESCRIPTION OF THE INVENTION

According to the present invention, these and other objects are achieved by a granular detergent showing improved detergency with respect to oily and greasy soil which contains a surfactant combination of (a) a water-insoluble to partially water-soluble (referred to hereafter simply as water-insoluble) nonionic surfactant containing glycolether groups, the nonionic surfactant being absorbed on a granular carrier material and (b) a water-soluble anionic surfactant of the sulfonate type and/or sulfate type. The granular detergent further contains builder salts and other standard detergent ingredients. The water-insoluble nonionic surfactant component of the detergent comprises the following constituents:

(i) an ethoxylated, linear or 2-methyl substituted, saturated or monounsaturated, primary alcohol having from 16 to 18 carbon atoms and containing on average from 4 to 6 glycolether groups;

(ii) an ethoxylated, linear or 2-methyl substituted, saturated, primary alcohol having from 10 to 14 carbon atoms and containing on average from 4 to 6 glycolether groups; and (iii) an ethoxylated alkylamine of the formula $R\text{-}NH_2$, wherein R is a linear, saturated alkyl moiety having from 10 to 18 carbon atoms, said alkylamine containing on average from 1 to 3 glycolether groups;

the ratio by weight of constituents (i) to (ii) to (iii) in the nonionic surfactant component being 1:(2–6):(0.8–2.5) and the weight proportion of the nonionic surfactant component (a) exceeding the weight proportion of the water soluble surfactant component (b).

The granular detergent of the present invention includes a mixture of a water-insoluble nonionic surfactant and a water-soluble anionic surfactant wherein the nonionic surfactant, which is absorbed on a granular carrier material, comprises the water-insoluble nonionic surfactant component and is formulated from three different constituents.

Because of their comparatively low degree of ethoxylation, the nonionic surfactants of component (a) normally are water-insoluble or at most are only partially water soluble, but in any event they are dispersible in water. The hydrophilic-lipophilic balance (hereinafter "HLB") of the nonionic surfactant mixture generally is below about 12 and is preferably between about 6 and 11.5. As used herein, a surfactant is water-soluble if it forms a clear solution in water at its temperature and concentration of usage. If the surfactant forms a cloudy dispersion or is immiscible with water at its temperature and concentration of usage, it is water-insoluble.

The first constituent of the nonionic surfactant, constituent (i), can be prepared from primary fatty alcohols of natural or synthetic origin, for example, by reaction with ethylene oxide. These fatty alcohols may be saturated or monounsaturated, linear or 2-methyl substituted (i.e. methyl-branched in the 2-position, hydroxy group). Constituent (i) preferably is an ethylene oxide adduct of a linear fatty alcohol, such as cetyl alcohol, stearyl alcohol, oleyl alcohol or mixtures thereof, for example, tallow fatty alcohols. The average number of glycolether groups (ethyleneoxy groups) in constituent (i) is from 4 to 6 and preferably is 5. Consistent with the statistical distribution typical of these adducts, the fatty alcohols may contain fractions having a relatively low degree of ethoxylation and other fractions having a relatively high degree of ethoxylation. As already mentioned, however, the average degree of ethoxylation (i.e. the statistical maximum) should be about from 4 to 6 and preferably is 5. The HLB value of constituent (i) is between about 7.5 and 10 and preferably is between about 8.2 and 9.3.

The second constituent of the nonionic surfactant, constituent (ii), also is derived from primary fatty alcohols or oxoalcohols. However, the alcohols are saturated and only contain from 10 to 14 carbon atoms. Ethylene oxide adducts of linear alcohols containing from 12 to 14 carbon atoms, such as lauryl alcohol, myristyl alcohol, and mixtures thereof are preferred. Particularly suitable starting materials for the surfactant are refined $C_{12}$–$C_{14}$ alcohol mixtures obtained from coconut oil fatty alcohols in which the proportion of relatively shortchain alcohols is preferably less than about 5% by weight. The average number of glycolether groups in constituent (ii) is from about 4 to 6, and preferably is 5. As with constituent (i), constituent (ii) may also contain fractions having a relatively low degree of ethoxylation and other fractions having a relatively high degree of ethoxylation, as long as the average number of glycolether groups falls within the above-mentioned range. The HLB value of the constituent (ii) is between about 8.5 and 12 and preferably is between about 9 and 11.5.

The third constituent of the nonionic surfactant, constituent (iii), can be derived from saturated primary alkylamines (i.e. N-monoalkylamines) having the formula $R\text{-}NH_2$ wherein R is a linear alkyl group having from 10 to 18 carbon atoms and preferably from 12 to 18 carbon atoms. Preferably more than 50% by weight of the alkylamines contain alkyl groups with from 12 to 14 carbon atoms and more preferably more than 65% by weight of the alkylamines contain alkyl groups with from 12 to 14 carbon atoms. As is well-known to those skilled in the art, these primary alkylamines can be obtained from primary fatty alcohols. In addition to synthetic alcohol mixtures, mixtures obtained from cocosalcohols, from which the fraction containing 10 or less carbon atoms has been substantially separated, are also suitable for preparing the primary alkylamines. The average number of glycolether groups in the ethoxylated primary alkylamines of constituent (iii) is from about 1 to 3 and preferably is 2. The preparation of these ethoxylated alkylamines is well-known to those skilled in the art. As with the other constituents, the ethoxylate mixture may contain fractions having a relatively low degree of ethoxylation and other fractions having a relatively high degree of ethoxylation, as long as the statistical distribution gives an average degree of ethoxylation within the above-mentioned range. The HLB value of the constituent (iii) is from about 4 to 8 and preferably is from about 5.5 to 7.5.

An important feature of the present invention is that the nonionic surfactant is prepared using specific relative amounts of constituents (i), (ii) and (iii). In particular, the ratio by weight of constituent (i) to constituent (ii) to constituent (iii) is within the range of 1:(2–6):(0.8–2.5) and preferably is within the range of 1:(3–5):(1–2). The preferred range represents a particularly well-balanced ratio suitable for cleaning greasy and oily soil from fabrics.

The other important surfactant component of the granular detergent of this invention comprises a water-soluble anionic surfactant of the sulfonate or sulfate type. Alkylbenzene sulfonates with linear alkyl groups containing from 10 to 13 and preferably 12 carbon atoms are particularly suitable. Other preferred anionic surfactants include alkyl sulfates derived from linear alcohols containing from 12 to 18 carbon atoms, alpha-sulfofatty acid alkyl esters derived from saturated fatty acids containing from 12 to 18 and preferably from 14 to 18 carbon atoms and alkanols containing from 1 to 3 carbon atoms, preferably methanol. Mixtures of the above-mentioned anionic surfactants also are suitable, particularly mixtures of alkylbenzene sulfonates and fatty alcohol sulfates in a weight ratio of from about 3:1 to 1:3 and mixtures of alkylbenzene sulfonates and alpha-sulfofatty acid esters in a weight ratio of from about 3:1 to 1:3. The anionic surfactants are generally used in the form of their alkali metal, e.g. sodium, salts.

Other suitable anionic surfactants which may optionally be present include alkyl sulfonates of the type obtained by sulfochlorination or sulfoxidation of paraffinic hydrocarbons containing from 12 to 18, preferably from 14 to 16, carbon atoms. The sulfonates obtained from terminal olefins by sulfonation with sulfur trioxide and subsequent hydrolysis also are suitable. Other known surfactants of the sulfonate or sulfate type may also be present, although they are not as important as the types mentioned above. It also is possible to use soaps of saturated or unsaturated $C_{12}$–$C_{18}$ fatty acids, although the detergent of the present invention generally does not have such soaps.

The detergent of the present invention contains less anionic surfactant than nonionic surfactant. The weight ratio of the nonionic surfactant, component (a), to the anionic surfactant, component (b), is preferably within the range of about 4:1 to 4:3 and more prefereably from about 3:1 to 3:2. Within this range, detergency with respect to both greasy soil and mineral soil is particularly good. The total amount of both the nonionic surfactant component (a) and the anionic surfactant component (b) in the detergent is between about 10 and 25% by weight, and preferably between 12 and 20% by weight.

The remainder of the granular detergent comprises a detergent builder and other standard detergent ingredients such as enzymes, bleaches, foam inhibitors, foam stabilizers and the like. The detergent builder typically comprises from about 35 to 50% by weight of the detergent of the present invention. Suitable builder salts for the detergent builders include synthetic sodium alumosilicates containing bound water and are preferably of the zeolite A type. It also is possible to use zeolite NaX and mixtures thereof with zeolite NaA, the content of zeolite NaX in these mixtures preferably being below about 30% and more preferably below about 20%, based on the zeolite content. Suitable zeolites generally contain particles smaller than about 30 microns in size and preferably at least 80% consist of particles smaller than 10 microns. The calcium binding power of the zeolite as determined in accordance with the teachings of German Patent Application No. 24 12 837 is in the range from 100 to 200 mg CaO/g (see also U.S. Pat. No. 4,148,603, column 18, lines 28–41).

Another useful detergent builder constituent is a homopolymeric and/or copolymeric carboxylic acid or the sodium or potassium salt thereof. Suitable homopolymers include polyacrylic acid, polymethacrylic acid and polymaleic acid. Suitable copolymers include a copolymer of acrylic acid or methacrylic acid with maleic acid; a copolymer of acrylic acid, methacrylic acid or maleic acid with vinyl ethers, such as vinyl methyl ether and vinyl ethyl ether; a copolymer of acrylic acid, methacrylic acid or maleic acid with vinyl esters, such as vinyl acetate, vinyl propionate, acrylamide or methacrylamide; and a copolymer of acrylic acid, methacrylic acid or maleic acid with ethylene, propylene or styrene. In copolymers such as these, in which one of the monomers has no acid (i.e., carboxyl) group, the content of that component should be no more than about 70 mole percent and preferably is less that about 60 mole percent of the copolymer in order to ensure adequate solubility of the copolymer in water.

Copolymers of acrylic acid and maleic acid of the type described, for example, in published European Patent Application No. 25 551-B1 are particularly suitable as a constituent of the detergent builders. These copolymers contain from about 40 to 90% by weight acrylic or methacrylic acid and from about 10 to 60% by weight maleic acid. Particularly preferred copolymers are those containing from 45 to 85% by weight acrylic acid and from 15 to 55% by weight maleic acid. The molecular weight of the above-mentioned homo- or copolymers is generally from 1000 to 150,000 and preferably from 1,500 to 100,000.

Another useful constituent of the detergent builder comprises sodium silicate having a weight ratio of $Na_2O:SiO_2$ in the range of about 1:2 to 1:3.5 and preferably in the range of about 1:2.5 to 1:3.3. It also is possible to use mixtures of silicates having differing alkali contents, for example, a mixture of (i) silicates having a $Na_2O:SiO_2$ weight ratio of about 1:2 and (ii) silicates having a $Na_2O:SiO_2$ weight ratio in the range of about 1:2.5 to 1:3.3.

Normally, the zeolite content of the detergent is between about 10 and 40% by weight and preferably is between about 12 and 20% by weight. The polymeric or copolymeric carboxylic acid (or salt) content of the detergent generally is between about 0.5 and 5% by weight and preferably is between 0.8 and 4% by weight. The sodium silicate content of the detergent typically is between about 1 and 7% by weight and preferably is between about 2 and 6% by weight.

Other suitable builder salts useful in the present invention are sodium carbonate and, in cases where environmental and other considerations permit, polyphosphates, especially pentasodium tripolyphosphate. The polyphosphate content may be up to 25% by weight, although it is preferably in the range from about 5 to 22% by weight. In circumstances where phosphates cannot be used, they may be replaced, for example, by sodium nitrilotriacetate in quantities of from about 2 to 10% by weight. It also is possible to use other known water-soluble phosphate substitutes, for example, polyacetals of glyoxylic acid in the form of their sodium salts.

The detergent builder salt component often also includes complexing agents of the aminopolycarboxylic acid and polyphosphonic acid type which generally are present in comparatively small amounts in the detergent. This ingredient acts as a so-called co-builder, stabilizer and threshold substance. Suitable aminopolycarboxylic acids include ethylene diamine tetraacetic acid (EDTA), diethylene triamine pentaacetic acid and higher homologs thereof. Suitable polyphosphonic acids include 1-hydroxyethane-1,1-diphosphonic acid, aminotri-(methylenephosphonic acid), ethylene diamine tetra-(methylenephosphonic acid) and higher homologs thereof, such as for example, diethylene triamine tetra(-methylenephosphonic acid). The above-mentioned polycarboxylic and polyphosphonic acids are normally used in the form of their sodium or potassium salts and in quantities of from about 0.1 to 5% by weight, preferably from about 0.2 to 1% by weight.

Other standard detergent ingredients which typically are included in the granular detergent of this invention are redeposition inhibitors, optical brighteners, enzymes, bleaches, bleach activators, foam inhibitors, dyes, perfumes, biocides, neutral salts and additives which improve the powder quality to name a few.

Suitable redeposition inhibitors include cellulose ethers, such as carboxymethyl cellulose, methyl cellulose, hydroxyalkyl celluloses, and mixed ethers, such as methylhydroxyethyl cellulose, methylhydroxypropyl cellulose and methylcarboxymethyl cellulose. Other suitable redeposition inhibitors are mixtures of carboxymethyl cellulose and methyl cellulose.

Suitable optical brighteners comprise alkali salts of 4,4-bis-(2″-anilino-4″-morpholino-1,3,5-triazinyl-6″-amino)-stilbene-2,2′-disulfonic acid or compounds of similar structure which contain a diethanolamino group instead of the morpholino group. It is also possible to use brighteners of the substituted diphenylstyryl type, for example, the alkali salts of 4,4′-bis-(2-sulfostyryl)-diphenyl, 4,4′-bis-(4-chloro-3-sulfostyryl)-diphenyl and 4-(4-chlorostyryl-4′-(2-sulfostyryl)-diphenyl.

Suitable enzymes are selected from proteases, lipases and amylases and mixtures thereof. Particularly suitable enzymes are those obtained from bacterial stains or fungi, such as *Bacillus subtilis, Bacillus licheniformis* and *Streptomyces griseus.* The enzymes may be coated or encapsulated to protect them against premature decomposition.

Suitable bleaches include the perhydrates and other "per"-compounds normally used in detergents and bleaches. Preferred perhydrates include sodium perborate, which may be present as a tetrahydrate or even as a monohydrate, the perhydrates of sodium carbonate (sodium percarbonate), sodium pyrophosphate (perpyrophosphate), sodium silicate (persilicate) and the perhydrates of urea. These perhydrates are preferably used in conjunction with bleach activators.

It is preferred to use sodium perborate tetrahydrate in conjunction with bleach activators as the bleach component. The bleach activators include in particular poly N-acyl and O-acyl compounds. Examples of suitable N-acyl compounds include polyacylated alkylene diamines, such as tetraacetyl methylene diamine, tetraacetyl ethylene diamine and higher homologs thereof and acylated glycolurils, such as tetraacetyl glycoluril. Other examples include sodium cyanamide, N-alkyl-N-sulfonylcarbonamides, N-acylhydantoins, N-acylated cyclic hydrazides, triazoles, urazoles, diketopiperazines, sulfurylamides, cyanurates and imidazolines. In addition to carboxylic acid anhydrides, such as phthalic acid anhydride, and esters such as Na (iso) nonanoyl phenol sulfonate, particularly suitable O-acyl compounds include acylated sugars, such as glucose pentaacetate. Preferred bleach activators include tetraacetyl ethylene diamine and glucose pentaacetate. The bleach activators may also be protectively coated or encapsulated to avoid interactions with the per-compounds, particularly during the storage of the granular detergent.

Suitable foam inhibitors include organopolysiloxanes and mixtures thereof with microfine and optionally silanized silica, paraffins, waxes, microcrystalline waxes and mixtures thereof with silanized silica and also saturated $C_{18}$–$C_{24}$ fatty acids and alkali soaps thereof. Mixtures of different foam inhibitors, for example, silicones and paraffins, may also be used.

Other constituents include neutral salts, especially sodium sulfate and magnesium silicate which act as stabilizers for the per-compounds. Other washing aids include additives which improve the granular structure, for example alkali salts, toluene, cumene and xylene sulfonic acid.

These other common detergent constituents may be present in quantities normally found in detergent compositions in general. For example, the redeposition inhibitor content is generally from about 0.2 to 2% by weight. The optical brightener content typically ranges from about 0.05 to 0.5% by weight. The enzyme content is determined primarily by the activity of the enzyme used. Commercial enzyme preparations, which are normally mixed with stabilizers, calcium salts and diluents and adjusted to a certain activity, are generally used in a quantity of from about 0.1 to 2% by weight. The perborate content is normally about 5 to 25% by weight. The quantities in which the bleach activators are used again depend on their activity. Highly active activators, such as tetraacetyl ethylene diamine, are normally used in quantities of from about 0.5 to 5% by weight. The same also applies to foam inhibitors which, in the case of highly active silicone defoamers, are generally used in a quantity of from about 0.01 to 0.5% by weight and, in the case of wax-like, paraffinic substances or relatively high molecular weight fatty acids, in a quantity of up to about 2% by weight. The sodium sulfate content may be up to about 25% by weight and, in special cases, even higher.

The detergents of the present invention may be in the form of granular powders or powder mixtures which may be suitably obtained by granulation, spray-drying, spray-mixing, homogenization or by a combination of these processes. Since the nonionic surfactant component comprises a liquid, potentially tacky ingredient which is not readily suited for spray-drying because of its tendency towards "pluming", the nonionic surfactant component should first be absorbed on a carrier substance. Suitable carrier substances include the detergent builder salt component, particularly zeolites, phosphates, silicates, nitrilotriacetate as well as spray dried mixtures of the detergent builder salt component with the anionic surfactant component and other detergent additives, providing the mixture is stable under spray-drying conditions. Carriers consisting of builder salts may additionally contain neutral salts, such as sodium sulfate, redeposition inhibitors, magnesium silicate and also additional adsorbents, such as finely divided silica, finely divided aluminum oxide, smectite clays, layered silicates and bentonites.

Instead of spray-dried mixtures, builder salt mixtures produced by build-up granulation also may be used as carriers for the nonionic surfactant component. After application of the nonionic surfactant to these carrier materials, the granules may be coated with adsorbing, nonstick materials, for example, powders of the above-mentioned finely divided absorbents.

In one particularly preferred embodiment of the present invention, from 30 to 100% by weight of the detergent builder component is in the form of granules containing the zeolite, the salt of the polymeric or copolymeric carboxylic acid and the sodium silicate or at least part of the total sodium silicate present. Suitable granules have the following composition (in % by weight, based on the granule):

- from 60 to 80% and preferably from 65 to 75% zeolite;
- from 3 to 20% and preferably from 4 to 15% polycarboxylic acid salt;
- from 0.1 to 2% and preferably from 0.15 to 1% sodium silicate;
- from 8 to 18% and preferably from 10 to 16% hydrated water, the water being removable at a drying temperature of 145° C.; and
- from 0.5 to 5% and preferably from 2 to 4% of a dispersion stabilizer.

Dispersion stabilizers are compounds which stabilize aqueous or paste-like zeolite dispersions. The stabilizers generally are added to the zeolite dispersions during their preparation or to a moist filter cake of the zeolite and they typically remain in the zeolite, throughout further processing. As suitable dispersion stabilizers please refer, for example to U.S. Pat. No. 4,438,012. Examples of stabilizers such as these include neutral salts, such as sodium sulfate, nonionic surfactants from the class of ethoxylated fatty alcohols containing from 12 to 18 carbon atoms and from 3 to 10 glycolether groups and also polymeric and copolymeric carboxylic acids. In this embodiment, the dispersion stabilizer preferably at least partly comprises constituent (i) of the nonionic surfactant component.

A preferred granule, which is preferably prepared by spray-drying, is described in detail in German Application No. 34 44 960 (copending U.S. application Ser. No. 807,065). This granule has an average particle size of from about 0.2 to 1.2 mm and contains less than about 2% by weight of fines (particles under 0.05 mm) and no more than about 5% by weight of coarse fractions (particles over 2 mm). The granule has a powder density of from about 400 to 700 g/l, and is characterized by its very high adsorption capacity for liquid or paste-like substances. Thus, this granular adsorbent is particularly suitable as a carrier for the nonionic surfactant component of the present invention.

In another preferred embodiment, the detergent of the present invention comprises a mixture of several different component powders. Suitable component powders include the following:

(I) A component powder consisting of the above-described zeolite granule containing a copolymeric carboxylic acid salt, sodium silicate and water, wherein the nonionic dispersion stabilizer and the nonionic surfactant component of the present invention are absorbed of the granule.

(II) A component powder consisting of the anionic surfactant component, the detergent builder salt components not present in the granule and other standard detergent ingredients, provided they are suitable for spray-drying. These other ingredients include complexing agents, redeposition inhibitors, optical brighteners, neutral salts and the like.

(III) One or more component powders containing constituents which, for reasons of stability, must not come into direct contact with constituents included in component powders (I) and (II) or which cannot be spray-dried. Such constituents include bleaches, bleach activators, foam inhibitors, enzymes, perfumes, biocides and the like. They are generally prepared separately or converted into a suitable powder or granule form and mixed with the other component powders. Liquid constituents, such as perfume oils, also may be sprayed onto other granular component powders, for example, a perborate, and added to the mixture. The foam inhibitors also are preferably applied to an adsorbing carrier substance or coated with a water-soluble coating material to protect them against interactions with other powder constituents which would result in loss of activity.

The present invention also relates to methods of making the detergent of the present invention. According to these methods, a granule having the following composition (in % by weight):

from 60 to 80% and preferably from 65 to 75% zeolite;

from 3 to 20% and preferably from 4 to 15% polycarboxylic acid salt;

from 0.1 to 2% and preferably from 0.15 to 1% sodium silicate;

from 8 to 18% and preferably from 10 to 16% hydrated water, the water being removable at a drying temperature of 145° C.; and from 0.5 to 5% and preferably from 2 to 4% of a dispersion stabilizer;

is prepared by spray-drying. The granule then is impregnated with the nonionic surfactant component and component powder (I) is thereby obtained. Component powder (I) is mixed with a spray-dried component powder (II) and with component powder(s) (III) having the compositions specified above.

In preparing component powder (I), it is important to limit the sodium silicate content within the range recited above. If a considerably higher sodium silicate concentration is desired in the detergent, the surplus should be added to the other component powders, preferably to the spray-dried component powder (II). Higher sodium silicate concentrations in the granule of component powder (I) lengthens the granule's disintegration time and thus impairs its solubility in the wash water. This in turn delays the release of the nonionic surfactant which ultimately adversely affects the washing results. This division of sodium silicate between two different component powders is another novel aspect of the invention.

Further information on the production of the granulate and its impregnation with nonionic surfactants can be found in German Patent Application No. 34 44 960 (copending U.S. application Ser. No. 807,065) to which reference is specifically made herein.

The detergent of the present invention is characterized by a high detergency, particularly with respect to difficult to remove greasy stains, for example, those caused by food and gravy, skin fat (sebum), lipstick and mascara. Despite the comparatively high content of liquid nonionic surfactant in the granular detergent, it is easy to pour, flows freely and does not saturate cardboard packages with its fatty content. If the detergent is produced by the preferred method, i.e., adsorption of the nonionic surfactant component on the performed granule of zeolite, polymeric acid and sodium silicate, pluming of the nonionic component in the off-gases of the spray-drying towers is completely avoided.

Although certain embodiments of the invention have been selected for description in the example hereinafter, it will be appreciated by those skilled in the art that this example is merely illustrative of, but does not in any way limit, the scope of the present invention which is defined in the appended claims.

EXAMPLE 1

Absorbent granules having the following composition (PBW=parts by weight) were prepared by spray-drying in accordance with German Patent Application No. 34 44 960 (copending U.S. application Ser. No. 807,065).

46.7—PBW zeolite NaX (based on anhydrous substance)

5.0—PBW copolymer (sodium salt)

0.14—PBW sodium silicate 1.56—PBW ethoxylated tallow alcohol (part of constituent (i))

0.6—PBW sodium sulfate 13.6—PBW water, including 8.9 PBW removable by drying at a temperature of 145° C.

67.6—PBW Total

The zeolite had a particle size of from about 1 to 8 microns, the fraction having a particle size greater than 8 microns amounting to about 6% by weight. There were no particles larger than 20 microns. The polycarboxylic acid was a copolymer of acrylic acid and maleic acid having an average molecular weight of 70,000 (Sokalan TM CP 5 sold by BASF, AG, Ludwigshafen, Germany) in the form of the sodium salt. The ethoxylated fatty alcohol was a tallow alcohol (30% by weight cetyl alcohol, 70% by weight stearyl alcohol), reacted with 5 moles ethylene oxide (hereinafter referred to as "EO"). This exthoxylated fatty alcohol corresponded to a portion of constituent (i).

The grain size distribution of the granule, determined by sieve analysis, was as follows:

| grain size range (mm): | over 1.6 | 1.6 to 0.8 | 0.8 to 0.4 | 0.4 to 0.2 | 0.2 to 0.1 | under 0.1 |
|---|---|---|---|---|---|---|
| % by weight | 0 | 1 | 37 | 53 | 9 | 0 |

The granule density was 550 g/liter.

67.6 parts by weight of the granules were sprayed with a molten mixture of nonionic surfactants in a spray mixer consisting of a cylindrical drum inclined to the horizontal and equipped with mixing elements and spray nozzles (LODIGE mixer). The temperature of the granules was 20° C. and the temperature of the surfactant melt was 50° C. The surfactant mixture consisted of 4.1 parts by weight of an ethoxylated tallow alcohol containing 5 EO (remainder of constituent (i)), 20 parts by weight of an ethoxylated lauryl alcohol-myristyl alcohol mixture (2:1 weight ratio) containing 5 EO (constituent (ii)) and 8.3 parts by weight of an ethoxylated cocosalkylamine ($C_{12}$–$C_{18}$ mixture, average chain length $C_{13.5}$) containing 2 EO (constituent (iii)). After cooling, a non-tacky product was obtained. The product had excellent fluidity despite the presence of a total of 34% by weight of liquid nonionic surfactant. The product had a powder density of 740 g/liter.

30 parts by weight of the granules impregnated with nonionic surfactants (component powder (I)) were mixed with 54.7 parts by weight of a spray-dried powder (component powder (II)) containing sodium dodecylbenzene sulfonate, sodium tripolyphosphate, sodium ethylene diamine tetramethylene phosphate (EDTMP), cellulose ether, sodium silicate, optical brightener and sodium sulfate. Granulated enzymes, granulated silicon defoamer, sodium perborate and granulated tetraacetyl ethylene diamine (TAED) were added as further powder constituents. These powdered constituents were combined as "component powder (III)" which was present in a total quantity of 15.3 parts by weight.

The detergent had the following composition (in % by weight of total detergent):

$C_{16}$–$C_{18}$ alcohol+5 EO: 1.7
$C_{12}$–$C_{14}$ alcohol+5 EO: 6.0
$C_{12}$–$C_{18}$ alkylamine+2 EO: 2.5
Sodium dodecylbenzene sulfonate: 5.0
Zeolite NaX (anhydrous): 14.0
Acrylic acid-maleic acid copolymer (sodium salt): 1.5
Sodium tripolyphosphate: 20.0
EDTMP: 0.3
Sodium silicate (incl. 0.04% in the granulate): 4.0
Cellulose ether: 0.5
Optical brightener: 0.2
Enzyme: 0.5
Defoamer (silicone content 30%): 0.3
Sodium perborate: 12.0
TAED: 2.5
Sodium sulfate: 18.5
Water: 10.5

Comparison tests were carried out with artificially soiled fabric samples. The soil applied to cotton fabrics under reproducible conditions consisted of make-up cream, mascara and lipstick. The samples were loaded together with 3 kg of ballast laundry into commercial domestic washing machines (load capacity 4 kg dry laundry) and washed at temperatures of 60° C. and 95° C. (easy-care program and boil wash program with 20 minutes prewashing at 25° C. respectively). The washing time, including heating in the main wash cycle, was 40 minutes; the detergent concentration was 7.5 g/liter; the ratio of fabric weight (in kg) to wash liquor (in liters) was 1:5 and the hardness of the tap water was 16° dH (160 mg CaO per liter). After three rinses, the fabrics were spun, dried and the remission value of the samples was photometrically determined. The results (reported below in Table II) are average values from 5 washing tests, each test involving 6 samples.

Detergents containing the following surfactants, but otherwise having the same compositions, were used for comparison (see Table I):

TABLE I

| | TEST NO. | | | |
|---|---|---|---|---|
| | 1 | 2 | 3 | 4 |
| Surfactant | Surfactant Content (PBW) | | | |
| Na dodecylbenzene sulfonate | 8.2 | 5.0 | 13.2 | — |
| Tallow alcohol + 5 EO | 2.0 | 2.0 | — | — |
| Tallow alcohol + 15 EO | 5.0 | 7.2 | — | 13.2 |
| Cocosalkylamine + 2 EO | — | — | 2.0 | 2.0 |

The tallow alcohol and cocosalkyl residues were identical in their qualitative and quantitative composition with those used in Example 1. The compositions in tests 1 and 2 correspond to the surfactant compositions of a commercial high-performance detergent. Tests 3 and 4 correspond to a detergent of U.S. Pat. No. 3,925,224.

The results are set out below in Table II. A reported value of 1 represents the highest cleaning ability while a reported value of 6 represents the poorest. The improved detergency of the detergent of the present invention is particularly noticeable in the 60° C. wash program.

TABLE II

| | Soil type: | | | | | | | |
|---|---|---|---|---|---|---|---|---|
| | Make-up | | Lipstick | | Mascara | | Average | |
| | Wash Temp. °C.: | | | | | | | |
| | 60° | 95° | 60° | 95° | 60° | 95° | 60° | 95° |
| Example 1 | 1.23 | 1.01 | 1.42 | 1.00 | 1.60 | 1.30 | 1.42 | 1.10 |
| Test 1 | 2.28 | 1.44 | 1.58 | 1.03 | 1.95 | 1.36 | 1.83 | 1.27 |
| Test 2 | 1.82 | — | 1.51 | — | 1.78 | — | 1.70 | — |
| Test 3 | 1.78 | — | 2.03 | — | 2.21 | — | 2.01 | — |
| Test 4 | 1.68 | — | 1.82 | — | 2.06 | — | 1.85 | — |

Although the present invention has been described in terms of a number of specific embodiments and an example, it will be appreciated by those skilled in the art that a wide variety of equivalents may be substituted for the specific parts and steps of operation described herein, all without departing from the spirit and scope of the present invention, as defined in the appended claims.

We claim:

1. A free-flowing granular detergent having improved cleaning ability with respect to oily and greasy soil, comprising:

(a) a water-insoluble, nonionic surfactant absorbed on a granular carrier, said nonionic surfactant comprising a mixture of:
  (i) an ethoxylated, linear or 2-methyl substituted, saturated or monounsaturated, primary alcohol having from 16 to 18 carbon atoms and containing on average from 4 to 6 glycolether groups;
  (ii) an ethoxylated, linear or 2-methyl substituted, saturated, primary alcohol having from 10 to 14 carbon atoms and containing on average from 4 to 6 glycolether groups; and
  (iii) an ethoxylated alkylamine of the formula R-$NH_2$, wherein R is a linear, saturated alkyl moiety having 10 to 18 carbon atoms, said ethoxylated alkylamine containing on average from 1 to 3 glycolether groups;

(b) a water-soluble anionic surfactant selected from the group consisting of sulfonate type surfactants, sulfate type surfactants and mixtures thereof; and (c) at least about 35% by weight of a detergent builder; the weight ratio of constituents (i) to (ii) to (iii) of the nonionic surfactant component being 1:(2–6):(0.8–2.5) and the weight proportion of the nonionic surfactant component to the anionic surfactant is from about 4:1 to 4:3 and the total content of the nonionic surfactants and the anionic surfactant is from about 10 to 25% by weight.

2. The detergent as defined in claim 1, wherein the weight ratio of (i) to (ii) to (iii) is in the range of 1:(3–5):(1–2), the weight ratio of the nonionic surfactant to the anionic surfactant is in the range of about 3:1 to 3:2 and the total content of the nonionic surfactant and the anionic surfactant in the detergent is from about 12 to 20% by weight.

3. The detergent as defined in claim 1, wherein the anionic surfactant is a sodium salt of a compound selected from the group consisting of alkylbenzene sulfonates containing linear alkyl chains having 10 to 13 carbon atoms, primary alkyl sulfates containing linear alkyl chains having 12 to 18 carbon atoms, alpha-sulfofatty acid alkylesters derived from saturated fatty acids having 12 to 18 carbon atoms and alkanols having 1 to 3 carbon atoms and mixtures thereof.

4. The detergent as defined in claim 1, wherein the detergent contains from 7 to 14% by weight of the nonionic surfactant component and from 3 to 7% by weight of sodium alkylbenzene sulfonate.

5. The detergent as defined in claim 1, wherein from 30 to 100% by weight of the detergent builder is present in the form of granules comprising from 60 to 80 parts by weight of a finely crystalline synthetic zeolite selected from the group consisting of NaA type zeolites, NaX type zeolites and mixtures thereof, from 0.1 to 2 parts by weight of sodium silicate having a weight ratio of $Na_2O:SiO_2$ in the range of 1:2 to 1:3.5, from 3 to 20 parts by weight of a copolymer of methacrylic acid and maleic acid, from 8 to 18 parts by weight of water removable by drying at a temperature of 145° C. and from 0.5 to 5% by weight of a dispersion stabilizer.

6. The detergent as defined in claim 5, wherein the nonionic surfactant component is adsorbed on the granules.

7. The detergent as defined in claim 1, wherein the detergent comprises a mixture of three component powders, (1) component powder (I) comprising granules with the nonionic surfactant adsorbed thereon, (2) a spray-dried component powder (II) comprising the anionic surfactant and standard detergent ingredients suitable for spray drying, and (3) component powder (III) containing at least one other standard detergent ingredient unsuitable for spray-drying.

8. The detergent as defined in claim 7, containing up to 25% by weight of sodium tripolyphosphate.

9. The detergent as defined in claim 8, wherein component powder (II) contains from 5 to 22% by weight of sodium tripolyphosphate.

10. A method of making the detergent defined in claim 1, comprising absorbing the nonionic surfactant component onto spray-dried granules to form a component powder (I) and mixing the component powder (I) with a spray-dried component powder (II) containing the anionic surfactant component.

* * * * *